US005570519A

United States Patent [19]

Solin et al.

[11] Patent Number: 5,570,519

[45] Date of Patent: Nov. 5, 1996

[54] METHOD AND DEVICE IN CONTACT-FREE TREATMENT OF A WEB

[75] Inventors: Richard Solin, Kemiö ; Matti Lepistö; Eelis Matilainen, both of Turku; Bertel Karlstedt, Parainen, all of Finland

[73] Assignee: Valmet Corporation, Helsinki, Finland

[21] Appl. No.: 386,376

[22] Filed: Feb. 10, 1995

[51] Int. Cl.[6] ..... F26B 13/20

[52] U.S. Cl. ..... 34/460; 34/631; 34/641; 34/644

[58] Field of Search ..... 34/460, 465, 631, 34/640, 641, 644

[56] References Cited

U.S. PATENT DOCUMENTS 4,854,052 8/1989 Korpela ..... 34/641
5,230,165 7/1993 Beisswanger .

FOREIGN PATENT DOCUMENTS 0507218 10/1992 European Pat. Off. .
0548419 6/1993 European Pat. Off. .

*Primary Examiner*—James Larson
*Attorney, Agent, or Firm*—Steinberg, Raskin & Davidson P.C.

[57] ABSTRACT

A method and device for contact-free treatment of a web in which the web is treated, for example supported, reversed, spread, carried, and/or dried, by blowings which provide a carrier-face zone. The carrier-face zone has a curved form regulatable in a direction transverse to the direction of progress of the web. The nozzle-carrier face unit of the device is bent to the curved form in the cross direction of the machine while a frame part of the device is kept in a stationary position. The device includes a regulation arrangement for bending the nozzle-carrier-face unit to a curve form in the direction transverse to the running direction of the web while the frame part of the device is supported in a stationary position.

19 Claims, 2 Drawing Sheets

METHOD AND DEVICE IN CONTACT-FREE TREATMENT OF A WEB

BACKGROUND OF THE INVENTION

The invention relates to a method in contact-free treatment of a web wherein the web is treated, for example supported, reversed, spread, carried, and/or dried, by means of blowings which provide a carrier-face zone having a curved form. The curved form of the carrier face zone is regulated in a direction transverse to the direction of progress or travel of the web.

The invention also relates to a device in contact-free treatment of a web, in particular in an application of drying, carrying, and/or equivalent of a paper, board or equivalent web. The device comprises a frame part or several frame parts and a nozzle-carrier-face unit arranged in connection with the frame part(s).

As is known in the prior art, in some applications of drying, carrying, etc. of a paper web, board web, or equivalent, a device is needed which is capable of correcting any factors that may be related to the run of the web in the transverse direction of the machine, such as wrinkles, folds, and instabilities of the web. One way to solve these problems is to produce a web curved in the transverse direction of the machine. In contact-free treatment of a web, this can be achieved by creating a curved carrier face for the air nozzles that are used. Airborne web drying is used, e.g., in various coating applications, in particular in applications in which both sides of the web are treated at the same time. One arrangement of this type is the coating-device arrangement marketed by the assignee under the tradename "Sym-Sizer Concept".

With regard to the prior art related to airborne web drying, reference is made to published EP Patent Application Ser. No. 0 507 218 which describes a dryer section including a contact-free web reversing device having a curved form so that the web is turned in the middle of the reversing curve, i.e., corresponding to the middle area of the web, to a greater extent than in lateral areas of the web. Further, in the device, the blow pressures are selected to be higher in the middle area than toward edges areas, so that the web obtains a curved form in the cross direction of the machine. It has been proposed that, by means of this arrangement, formation of waves in the web is reduced in the direction transverse to the running direction of the web, and formation of cockles is avoided. The curved form of the blow pressure profile can be provided either by means of a web reversing device that is accomplished with a curved form or by regulating the blow pressures accordingly. However, in the device described in EP '218, a suitable solution has not been described for carrying out any of the suggested operational modes.

A significant problem related to curved air nozzles is the problem of sealing between the curved and displaceable nozzle and the stationary and straight main frame of the air blow device. Gliding and compressible seals have been used in the prior art apparatus but these seals restrict the possible movement and give rise to associated requirements for servicing and repair thereof, and they often increase the number of various wearing parts.

With further regard to the prior art, reference is made to the EP Patent Application Ser. No. 0 548 419, in which a blow-reversing device is described. This blow-reversing device includes a nozzle part formed in a manner so as to be adjustable, by means of bolts, in a curved position in the cross direction of the machine. This prior art arrangement, however, requires separate and quite complicated sealing arrangements between the nozzle part and the frame part of the device to maintain an adequate seal. Also, in EP '419, in order to regulate the curved form, it is necessary to adjust a number of different screws, and moreover, access to these screws is possible only if other constructional parts of the device are shifted out of the way. Thus, it is a disadvantage of this device that it is difficult to easily and readily regulate its profile to provide the desired curved form.

OBJECTS AND SUMMARY OF THE INVENTION

It is an object of the present invention to provide a device and a method that are free from the prior art drawbacks described above.

It is a further object of the present invention to provide a new and improved arrangement in which the regulation of the curved form can be carried out readily.

It is still another object of the present invention to provide a new and improved method and device in which an adequate seal is provided between the nozzle which provides the curved carrier-face and the frame part during movement of the nozzle relative to the frame part.

In view of achieving the objects stated above and others, the method in accordance with the invention, in order to provide a curved carrier-face zone, a nozzle-carrier-face unit of the device is bent to a curved form in the cross direction of the machine while the frame part of the device is kept stationary in its operating position.

The device in accordance with the invention comprises a regulation arrangement or deflecting means by whose means the nozzle-carrier-face unit is bent to a curved form in a direction transverse to the running direction of the web while the frame part of the device is supported in a stationary position, i.e., thereby enabling movement of the nozzle relative to the frame part.

By means of the invention, an improved arrangement is achieved, in which there are no wearing sealing parts or equivalent and in which regulation of the curved form can be accomplished readily. The construction in accordance with the invention also permits bending of the carrier face of the nozzle by using comparatively low loading forces.

More particularly, the blow device in accordance with the invention comprises a nozzle part including means for distributing air to treat the web, e.g., nozzle slots, and a carrier face formed in connection with the nozzle part, and a main stationary frame which operates as an air supply chamber, i.e., constitutes means defining at least one air supply chamber. The nozzle part can be bent to be curved in the cross direction of the machine and is assembled in such a way by means of transverse fastening screws and nuts that bending of the assembly to a concave or a convex curved form is possible. The fastening screws pass through oblong, elliptic holes formed in side walls of the main stationary frame whereby the screws can move in the holes in accordance with the desired bending or deflection direction.

The bending movement to attain a curved form in itself is achieved locally by regulating an adjustment screw, which is placed preferably in the middle of the blow device in the cross direction of the machine. The adjustment screw displaces the nozzle part relative to the web in the desired bending direction, and since the lateral holes, i.e., the holes provided at ends of the side walls of the frame part or construction, are not oblong holes but ordinary circular holes, they function to fix each end of the nozzle part stationary in its position so that the achievement of a curved form is ensured when the middle parts of the nozzle assembly are displaced by means of the adjustment screw. In this manner, if the middle region of the nozzle part is displaced toward the web, a convex form is provided whereas if the middle region of the nozzle part is displaced away the web, a concave form is provided.

Thus, the device in accordance with the invention permits bending of the nozzle part assembly relative to the web by regulating the position of only a single adjustment screw. Of course, if blow devices wider in the cross direction of the machine are used, for example of a length larger than about 5 meters, it is possible to use several adjustment screws or other suitable deflection means.

A further advantageous feature of the invention consists of gliding partition walls situated between adjacent profiling blocks of the device arranged in a cross-machine direction which permit movement of the carrier-face assembly, i.e. of the nozzle-part assembly, without causing leakage between the profiling blocks arranged in the cross direction.

The device in accordance with the invention is preferably also provided with a limiter/indicator arrangement in order to control the degree of bending and to limit and/or indicate the extent of deflection of the nozzle part.

The device in accordance with the invention can be utilized in such nozzle constructions used for contact-free web treatment as are supposed to be bent to a curved form in the cross direction of the machine. The device in accordance with the invention is particularly suitable for use in various airborne nozzles and especially when a web is dried in connection with two-sided/one-sided pigmenting/size-pressing.

In the following, the invention will be described in detail with reference to some preferred exemplifying embodiments of the invention illustrated in the figures in the accompanying drawings. However, the invention is by no means strictly confined to the details of these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
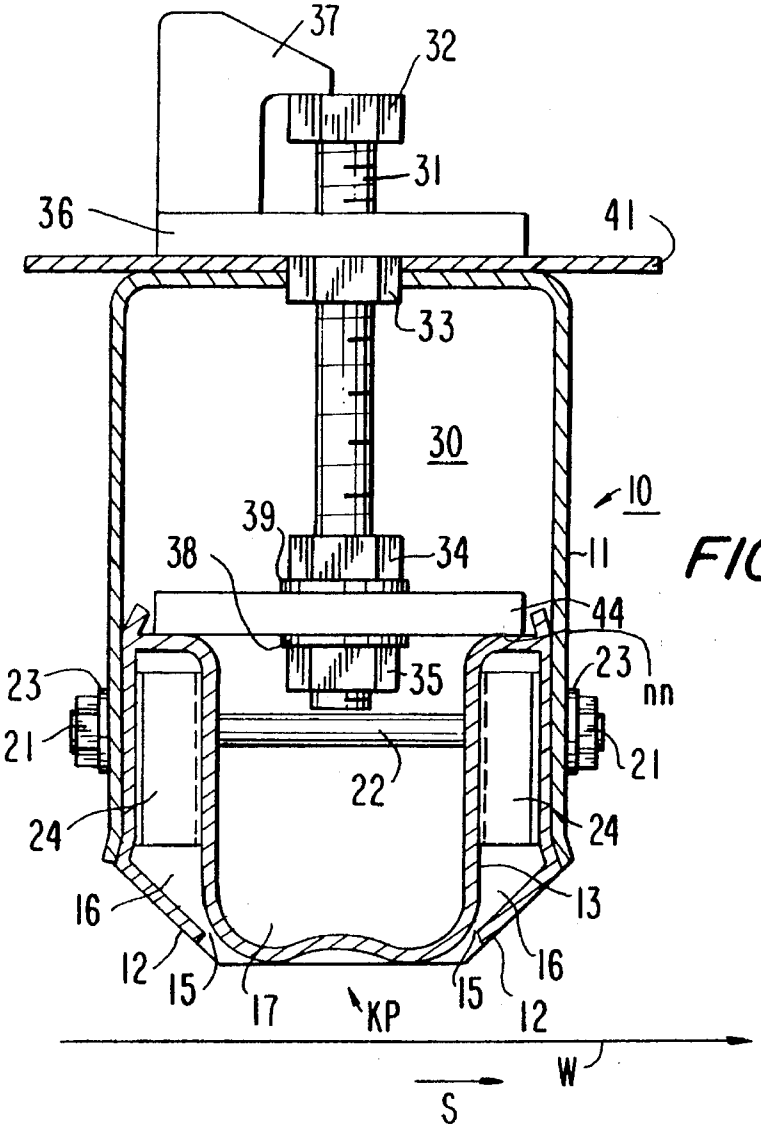
FIG. 1 is a schematic vertical sectional view of a device in accordance with the invention taken in the running direction of the web and used in a method in accordance with the invention.

Referring to the accompanying drawings wherein like reference numerals refer to the same elements, as shown in FIG. 1, a device 10 in accordance with the invention comprises a frame part or construction 11, which preferably has a U-shape and extends substantially across the entire width of a web W, i.e. in a direction transverse to the running direction S of the web W. A nozzle frame 13, having lip plates 12 connected thereto, is attached to the frame construction 11 by nuts 21, a transverse bolt 22, washers 23 and intermediate pieces 24. Obviously other fastening means for attaching the nozzle frame 13 to the frame construction 11 may be utilized. The nozzle frame 13 forms a carrier face KP in a substantially central region of the device 10. At both sides of the carrier face KP, nozzle openings 15 are formed between the lip plates 12 and the nozzle frame 13. Air is blown through these nozzle openings 15 in a direction substantially toward the web W or along the carrier face KP. A regulation arrangement 30 is attached to the frame construction 11 of the device 10 and comprises an adjustment screw 31, to which nuts 32, 34 and 35 are permanently fixed, e.g., by welding. Between nuts 34 and 35, having adjoining intermediate plates 39 and 38, respectively, a press member 44 is situated. The regulation arrangement 30, and more specifically adjustment screw 31, is passed through the frame construction 11 of the device 10 at a side opposite in relation to the side of the device 10 on which a nozzle construction or nozzle-carrier-face unit 17 is situated, i.e. opposite to the carrier-face assembly. The screw arrangement is supported against the frame construction 11 by means of a plate 41.

The press member 44 can be permanently fixed to the nozzle carrier face unit 17, and specifically to the nozzle frame 13 as shown in FIG. 1, at point nn by, e.g., welding. This fixed connection of the press member 44 to the nozzle frame 13 is necessary to enable movement of the nozzle frame 13 when the press member 44 is moved in a direction away from the plane of the web to provide a concave form.

The limiter/indicator parts of the regulation arrangement 30 are denoted by reference numerals 36 and 37 and function so that the maximum movement of the adjustment screw 31 is the displacement distance of nut 32 between member 37 and member 36. Member 36 can be joined to plate 41 if desired, e.g., by welding. Similarly, member 33 is welded to member 36 and extends through plate 41 and a top part of frame part 11. As shown in FIG. 1, the adjustment screw 31 is passed through member 33 but is not connected thereto so that adjustment screw 31 moves relative to member 33.

By means of the regulation arrangement 30, and more particularly the engagement of the press member 44 and a portion of the nozzle frame 13, the nozzle frame/lip plate assembly (12,13) is pressed toward the web W as far as desired, and permitted to be retracted away from the web when desired. In other words, the vertical movement of the adjustment screw 31, limited by member 33 and nut 32, results in movement of the press member 44 coupled to the adjustment screw 31 and also to the nozzle frame 13 of the nozzle carrier face unit 17 by virtue of the engagement of press member 44 and the nozzle frame 13. As to the element which initiates movement of the adjustment screw 31, since the adjustment screw 31 functions like a screw jack, it may be accomplished by placing threading on the outer surface of the adjustment screw 31 and on an inner cylindrical face of a limiter/indicator part 36 whereby the adjustment screw 31 is turned and thus displaced vertically relative to the part 36 by manually turning nut 32, e.g., by a fork wrench or an adjustable wrench, or even automatically by conventional, automated turning mechanisms. As such, the nut 32, the adjustment screw 31, nuts 34 and 35 all rotate relative to the fixed part 36 and press member 44 thereby providing vertical displacement of the press member 44 clamped between nuts 34 and 35 and thus the nozzle frame 13.

Figure 2:
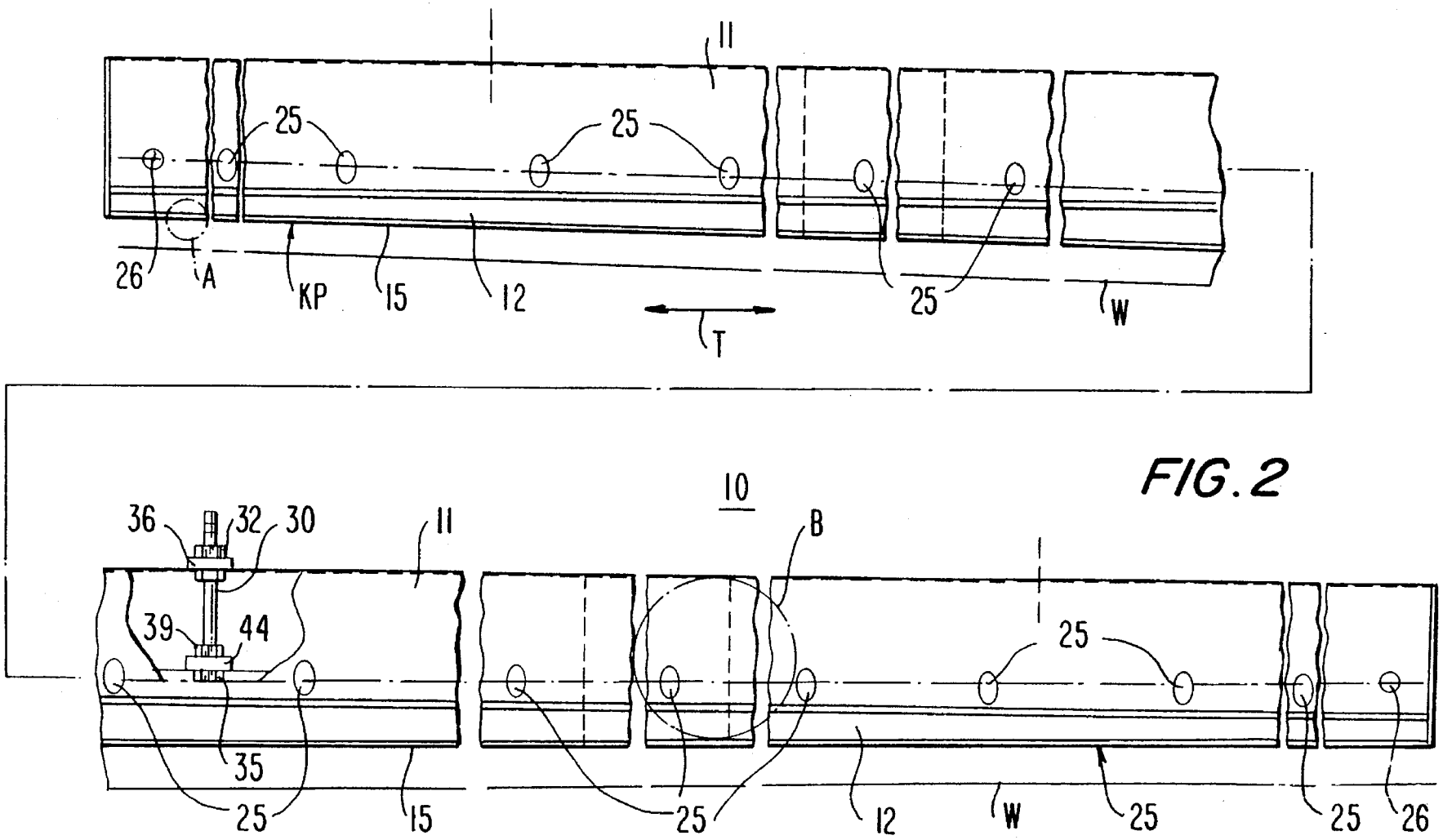
FIG. 2 is a schematic illustration of the device in accordance with the invention viewed in the cross direction of the web and used in a method in accordance with the invention.

As shown in FIG. 2, the nut-screw arrangement 21,22 (FIG. 1) is passed through oblong holes 25 formed in side walls of the frame part 11 whereby the nut-screw arrangement is capable of moving in a direction perpendicular to the plane of the web, i.e., vertically in the illustrated embodiment. The extreme lateral holes 26 receive screws, placed in the direction of width T at each edge of the device 10, are circular and thus fix the end parts of the nozzle-carrier-face unit 17 of the device 10 in stationary positions on the frame part 11 of the device 10. By means of the adjustment screw 31, the curved form of the nozzle-carrier-face unit 17 is adjusted in the direction transverse to the running direction S of the web W. Thus, with the arrangement in accordance with the invention, while the outer frame construction 11 remains straight as shown in FIG. 2, the nozzle-carrier-face unit 17 situated inside of the frame construction 11 is curved, i.e., has a curve-form in the direction transverse to the running direction S of the web W. In this manner, the web W is tensioned in the direction of width T via the air blowing through nozzle openings 15 in the nozzle construction 17, in which case its run is stabilized and it is not susceptible to the formation of waves or cockles.

Figure 3:
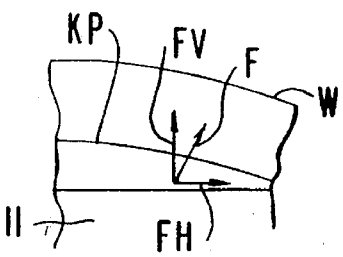
FIG. 3 is a schematic illustration in part of area A in FIG. 2.

FIG. 3 shows the area A in FIG. 2, in which the force components of the air blowings coming out of the nozzle slot or opening 15 are shown. According to the component diagram, it is seen that, when the nozzle-lip-plate arrangement is curved, the force component F is inclined, in which case it has force components FV (vertical component) and FH (horizontal component) perpendicular to the web and directed at the side of the web, respectively. Of these components, the component FH tensions the web W in the cross direction T.

Figure 4:
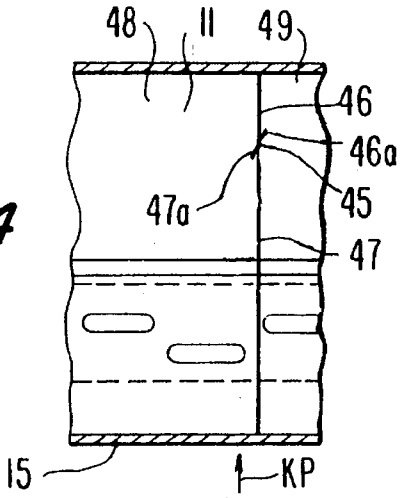
FIG. 4 is a schematic illustration in part of area B in FIG. 2.

As shown in FIG. 4, the air supply chamber formed by the frame construction 11 is divided or partitioned into discrete blocks 48,49 by means of partition walls arranged between the blocks. The partition walls consist of wall parts 46 and 47 having slanting surfaces 46*a*,47*a* at their adjacent ends, respectively, between which a displacement area 45 is formed. In this displacement area, the slanting surfaces 46*a*,47*a* of wall parts 46 and 47 engage with each other and glide against one another so that the movement of the carrier-face assembly does not cause leakage between the profiling blocks 48 and 49 placed in the cross direction.

The device 10 is provided with a closed end. The blow air is passed out of the block chambers 48,49 formed by the frame construction 11 into the nozzle chambers 16 and is blown out of the nozzle openings 15. The blowings produce a pressure zone on the carrier face KP which supports the web W and carries it further free of contact with the carrier face. By means of the transverse profiling chambers 48,49, the intensity of blowing is regulated in the cross direction of the machine if necessary.

Obviously other modifications of the inventive method and device are possible. For example, if a curved form other than a concave or convex form is desired, then the fixed points of the nozzle to the frame may be placed in locations other than at ends of the frame. In this manner, the nozzle carrier-face unit maybe bent in a direction transverse to the running direction of the web from a plurality of points placed at a distance from one another to enable the formation of a variety of curved forms.

The examples provided above are not meant to be exclusive. Many other variations of the present invention would be obvious to those skilled in the art, and are contemplated to be within the scope of the appended claims.

We claim:

1. A method for contact-free treatment of a web in which the web is treated by air blowings which provide a carrier-face zone, comprising the steps of blowing air to treat the web through a nozzle-carrier-face unit situated in a nozzle frame part arranged in a direction transverse to a direction of travel of the web, slidably coupling said nozzle-carrier-face unit to said nozzle frame part to enable relative displacement therebetween, and while maintaining said nozzle frame part in a stationary position, regulating a profile of said nozzle-carrier-face unit in the transverse direction to provide a curved form for said carrier-face zone.

2. The method of claim 1, further comprising the steps of supporting portions of said nozzle-carrier-face unit in a stationary position, said portions being situated at points substantially corresponding to edges of the web in a direction of width thereof, and bending said nozzle-carrier-face unit substantially from a middle region thereof in the direction of width of the web.

3. The method of claim 2, wherein said nozzle-carrier-face unit is bent such that said middle region of said nozzle-carrier face unit is displaced toward the web to thereby provide a convex form.

4. The method of claim 2, wherein said nozzle-carrier-face unit is bent such that said middle region of said nozzle-carrier face unit is displaced away from the web to thereby provide a concave form.

5. The method of claim 1, further comprising the step of bending said nozzle carrier-face unit in a direction of width of the web from a plurality of points placed at a distance from one another.

6. A device for contact-free treatment of a web, comprising at least one frame part supported in a stationary position, a nozzle-carrier-face unit arranged in a direction substantially transverse to a running direction of the web and being deflectable relative to the web, means for coupling said nozzle-carrier face unit to said at least one frame part to enable relative displacement therebetween, and means for deflecting said nozzle-carrier-face unit to provide a curved form for a carrier-face zone of said nozzle-carrier-face unit without displacing said at least one frame part.

7. The device of claim 6, further comprising connecting means for connecting portions of said nozzle-carrier-face unit substantially corresponding to edges of the web to said at least one frame part, said deflecting means being arranged substantially in a middle portion of said nozzle-carrier face unit.

8. The device of claim 6, wherein said deflecting means regulate the deflection of said nozzle-carrier-face unit in a plurality of locations spaced from one another in a direction transverse to the running direction of the web.

9. The device of claim 6, wherein said at least one frame part comprises means defining a plurality of air chambers spaced from one another in a direction transverse to the running direction of the web, said chamber defining means comprising partition walls.

10. The device of claim 9, wherein a pair of said partition walls are arranged between each adjacent pair of chambers, said pair of partition walls having slanting surfaces gliding tightly in relation to one another during displacement of said nozzle-carrier-face unit relative to said at least one frame part to provide a seal between said adjacent pair of chambers.

11. The device of claim 6, wherein said at least one frame part comprises opposed side walls having oblong holes formed therein, said coupling means comprising fastening members coupled to said nozzle-carrier-face unit and extending through said oblong holes, said fastening members being displaceable in said oblong holes in the direction of deflection of said nozzle-carrier-face unit.

12. The device of claim 11, wherein said at least one frame part further comprises a circular hole situated at each end thereof, further comprising connecting means for fixedly connecting said nozzle-carrier-face unit to said at least one frame part via circular holes.

13. The device of claim 6, wherein said deflection means comprise an adjustment screw coupled to said at least one frame part and engaging with said nozzle-carrier-face unit.

14. The device of claim 6, wherein said deflecting means comprise a limiter/indicator member for limiting and/or indicating the extent of deflection of said nozzle-carrier-face unit.

15. The device of claim 6, wherein said nozzle-carrier-face unit comprises means for directing air blowings into said carrier-face zone.

16. The device of claim 6, wherein said nozzle-carrier-face unit comprises a nozzle frame having lip plates attached thereto, said nozzle-carrier-face unit defining nozzle openings between said nozzle frame and said lip plates.

17. A method for contact-free treatment of a web is treated by air blowings which provide a carrier-face zone, comprising the steps of blowing air to treat the web through a nozzle-carrier-face unit situated in a nozzle frame part arranged in a direction transverse to a direction of travel of the web, supporting portions of said nozzle-carrier-face unit in a stationary position relative to said nozzle frame part, said portions being situated at points substantially corresponding to edges of the web in a direction of width thereof, and while maintaining said nozzle frame part in a stationary position, bending said nozzle-carrier-face unit substantially from a middle region thereof in the direction of width of the web to provide a curved form for said carrier-face zone.

18. The method of claim 17, wherein said nozzle-carrier-face unit is bent such that said middle region of said nozzle-carrier face unit is displaced toward the web to thereby provide a convex form.

19. The method of claim 17, wherein said nozzle-carrier-face unit is bent such that said middle region of said nozzle-carrier face unit is displaced away from the web to thereby provide a concave form.

* * * * *